US007131245B2

(12) United States Patent
Joerg et al.

(10) Patent No.: US 7,131,245 B2
(45) Date of Patent: Nov. 7, 2006

(54) OVER-CENTER SELF-ADJUSTING EQUALIZING CAP CHUCK

(75) Inventors: Andreas Wilhelm Joerg, Keeneyville, IL (US); Thomas Alan Wilke, Schaumburg, IL (US)

(73) Assignee: Diamond Machine Werks, Inc., Elk Grove Village, IL (US)

( * ) Notice: Subject to any disclaimer, the term of this patent is extended or adjusted under 35 U.S.C. 154(b) by 115 days.

(21) Appl. No.: 11/034,189

(22) Filed: Jan. 12, 2005

(65) Prior Publication Data

US 2006/0150580 A1 Jul. 13, 2006

(51) Int. Cl.
*B67B 3/20* (2006.01)
*B65B 7/28* (2006.01)

(52) U.S. Cl. ..... 53/317; 53/331.5; 279/33; 279/106

(58) Field of Classification Search ..... 53/317, 53/331.5, 334, 341, 349, 351, 353, 355, 346, 53/345, 344; 279/106, 33, 132–134; *B67B 3/20*
See application file for complete search history.

(56) References Cited

U.S. PATENT DOCUMENTS

| | | | | | |
|---|---|---|---|---|---|
| 2,479,560 | A * | 8/1949 | Eaton | 279/33 |
| 3,016,245 | A * | 1/1962 | Von Zelewsky | 279/106 |
| 3,472,526 | A * | 10/1969 | Hohwart | 279/106 |
| 3,975,029 | A * | 8/1976 | Benjamin | 279/106 |
| 3,995,869 | A * | 12/1976 | Mazingue | 279/33 |
| 4,178,733 | A | 12/1979 | Dankert | |
| 4,222,215 | A * | 9/1980 | Takano | 53/331.5 |
| 5,135,242 | A | 8/1992 | Toth | |
| 5,417,031 | A | 5/1995 | Bankuty et al. | |
| 5,941,538 | A | 8/1999 | Gonnocci | |
| 6,170,232 | B1 | 1/2001 | VandeGeijn | |
| 6,206,382 | B1 | 3/2001 | Gonnocci | |
| 6,240,678 | B1 | 6/2001 | Spether | |
| 6,655,699 | B1 | 12/2003 | Grobbel | |

FOREIGN PATENT DOCUMENTS

WO WO 2004009484 A1 * 1/2004

* cited by examiner

*Primary Examiner*—Stephen F. Gerrity
(74) *Attorney, Agent, or Firm*—James P. Hanrath

(57) ABSTRACT

An over-center self adjusting cap chuck adapted for operative attachment to a high-speed capping machine includes a housing having an outer peripheral surface defining an inner annular periphery with an interior face. A plurality of independent engagement jaws are aligned along an annular area of, or within a pocket area of, the interior face. Each engagement jaw has a fastener to connect the engagement jaw to the housing and establish a pivot point to support a limited axial rotational movement thereof to a first open axial position and a second closed axial position for receiving and gripping a work piece respectively. Either a singular bias spring or a pair of bias springs pre-dispose the engagement jaws to the first open axial position. The engagement jaws include an upper beveled area above a work piece engagement finger that serves as an actuator when contacted by a work piece for self-adjusting movement to the second closed axial position whereby the gripping pressure upon the work piece is direct toward a center-point of a work piece receiving area until the pressure thereon is equalized.

26 Claims, 16 Drawing Sheets

OVER-CENTER SELF-ADJUSTING EQUALIZING CAP CHUCK

BACKGROUND OF THE INVENTION

1. Field of the Invention

The present invention relates generally to chucks, and more particularly to an over-center self-adjusting, equalizing cap chuck adapted for high-speed capping operations of bottle caps, especially bottle caps having a serrated outer periphery.

2. Description of the Related Art

The filling and capping process generally entails supplying containers along a conveyor, automatically filling them at a filling station, and automatically capping them at a capping station. Various testing and control functions may also be performed along the way. The apparatus that performs the process must be capable of accommodating a wide variety of containers and caps (both caps and containers may vary in size and shape), and this is accomplished by a universal chuck which allows quick and easy grasping and manipulation of different cap sizes.

Current common methodology for screw cap positioning and torque include the tapered chuck, the friction disk chuck, the donut chuck, and the segmented chuck, a description of which and the shortcomings of which may be found at the background art discussion of U.S. Pat. No. 6,170,232 to VandeGeijn. Thus, various designs have been suggested for bottle capping chucks.

The development of high-speed machining applications have required bottle capping chucks to operate at significantly higher rotational speeds for caps of varying size and characteristics, such as wall thickness and flexibility. Thus, adjustable chucks of the type in widespread use for gripping work pieces of different sizes typically include a number of internal moving parts, including, for example rocker arms, swivel mountings, bearings, slide members, toggle links, equalizing plates, and other complementary components interactive with each other, which serve to open and close or interact with the gripping jaws. Smooth operation of these parts is most important to assure that a positive clamping of the work piece is achieved when the jaws are closed, and further that each of the jaws applies equal pressure against work piece to prevent distortion and possible eccentric location of the work piece. Illustrative of such chucks are those designs disclosed in U.S. Pat. No. 6,665,699 to Grobbel, and U.S. Pat. Nos. 6,206,382 and 5,941,538 to Gonnocci.

The speeds at which chucks are used in moderate manufacturing processes have placed increasing importance upon the rotational balance of the chuck and the work piece held therein. For example, an imbalance may cause improper machining which results in rejection of the work piece. Alternatively, an imbalance may create a change in the gripping force as a result of the centrifugal force created by the rotation of the gripping jaw. Thus, it is desirable to provide a chuck which maintains a proper balance and constant gripping force independent of a capping machine's rotational spindle assembly speed, is selectively self-adjusting to allow light engagement of the cap and containers threads and to provide light contact between the threads during rotation of the cap, and is readily adjustable to variations in cap size and characteristics to insure undamaged concentric alignment during capping operations.

Additionally, it would be advantageous if a self-adjusting cap chuck addressing the foregoing needs could be used in a variety of capping machinery by ready adaptation to a spindle assembly thereof. Indeed, the entirety of U.S. Pat. No. 6,240,678 to Spether, U.S. Pat. No. 6,170,232 to VaneGeijn, U.S. Pat. No. 5,417,031 to Bankuty et al., and U.S. Pat. No. 5,135,242 to Toth are hereby incorporated by reference for their general teachings of capping machinery utilizing cap chucks.

SUMMARY OF THE INVENTION

According to the present invention there is provided an over-center self-adjusting equalizing cap chuck comprising:

a housing having an outer peripheral surface and an inner annular periphery, an external face adapted for operative attachment to a capping machine, and an internal face having a work piece receiving central area and an annular area bordering the inner annular periphery;

a plurality of engagement jaws disposed along the annular area, each engagement jaw having a central portion, a first side portion, and a second side portion, the central portion having a cavity that accommodates a fastener therein to connect the engagement jaw to the housing and to establish a pivot point of the engagement jaw supporting limited axial rotational movement of the engagement jaw between a first axial position and a second axial position, the first side portion having a bias spring at a surface proximal of the inner annular periphery of the housing that pre-disposes the engagement jaw to the first axial position, an upper beveled area at least partially traversing an extension finger at a surface distal of the inner annular periphery of the housing, which, in use, serves as an actuator countering the bias spring when first contacted by a work piece;

the second side portion having a surface proximal of the inner annular periphery which, in use, is initially disposed by the bias spring to abut the inner annular periphery but upon the upper beveled area being actuated by the work piece moves away from the inner annular periphery, the extension finger, in torque use, being capable of contacting an outer periphery of the work piece to apply gripping pressure in a direction toward a center-point of the work piece receiving central area of the internal face, and each of the engagement jaws being independent of each other and exerting separate points of pressure upon a work piece until the pressure thereon is equalized.

The present invention also includes an over-center self-adjusting equalizing cap chuck comprising:

a housing having an outer peripheral surface, an interior surface having a plurality of pocket areas, an external face adapted for operative attachment to a capping machine, and an internal face having a work piece receiving central area bordering the interior surface;

a plurality of engagement jaws, each engagement jaw disposed within one of the pocket areas, the pocket areas defined, in part, by opposing walls each having a bore therein, each engagement jaw having a rear portion, a front portion, and a side periphery, the rear portion having a cavity that accommodates a fastener therein to connect the engagement jaw within the pocket area and to establish a pivot point of the engagement jaw supporting limited axial rotational movement of the engagement jaw between a first axial position and a second axial position within the pocket area, a pair of bias springs extending from the bores of the opposing walls and interactive with the engagement jaw there between that pre-disposes the engagement jaw to the first axial position, the front portion of the engagement jaw having an extension finger at a frontal surface thereof, the extension finger having an upper beveled area, which, in use, serves as an actuator when contacted by the work piece to counter the bias springs and accommodate the limited axial movement of the engagement jaw to the second axial position;

the extension finger, in torque use, being capable of contacting an outer periphery of the work piece to apply gripping pressure in a direction toward a center-point of the work piece receiving central area of the internal face, and each of the engagement jaws being independent of each other and exerting separate points of pressure upon the work piece until the pressure thereon is equalized.

The embodiments of the present invention advantageously provide a cap chuck engagement of a work piece with a gripping pressure applied in a direction toward a center-point of the work piece receiving area. This over-center engagement, in torque use, achieves an efficient hold of cap chuck engagement jaws against the work piece with a minimal degree of grip force. This is particularly advantageous because the work piece may be received within the chuck with a desirable minimal or light initial grip force to avoid nicks or abrasion of the work piece's outer periphery, yet in torque use during high-speed spindle capping machine operations, the over-center grip upon the work piece achieves a strong hold during capping or de-capping.

Further, the cap chucks of the present invention can accommodate eccentricities, deviations, and variations in work piece cap size or characteristics in that the cap chucks are self-adjusting and equalizing by providing engagement jaws which have limited axial rotational movement between first and second axial positions. Such engagement exerts separate and independent points of pressure upon a work piece in the same axial plane until the pressure thereon is equalized to insure undamaged concentric alignment during capping operations.

Still further, the present invention can also provide a more direct angle of contact of the engagement jaw to the work piece accommodating even finely serrated bottle caps without contact point slippage over bottle cap splines.

Still further, the cap chucks of the present invention provide a simplified means without resorting to complex internal moving parts by which a high performance precision equalizing chuck can be adapted for use in high speed applications without adversely effecting the clamping force generated thereby.

Still further, the cap chucks of the present invention are readily adapted for quick-change connection to a variety of prior art capping machine spindle assemblies.

Additional features and advantages of the present invention will become apparent to those skilled in the art from the following description and the accompanying figures illustrating preferred embodiments of the invention, the same being the present best mode for carrying out the invention. It should be understood that the detailed specifics and examples, while indicating the preferred embodiment of the invention, are indicated for purposes of illustration only and not intended to limit the scope of the invention.

DESCRIPTION OF THE PREFERRED EMBODIMENTS

The following description of the preferred embodiments is merely exemplary in nature and is in no way intended to limit the invention, its application, or uses.

Figure 1:
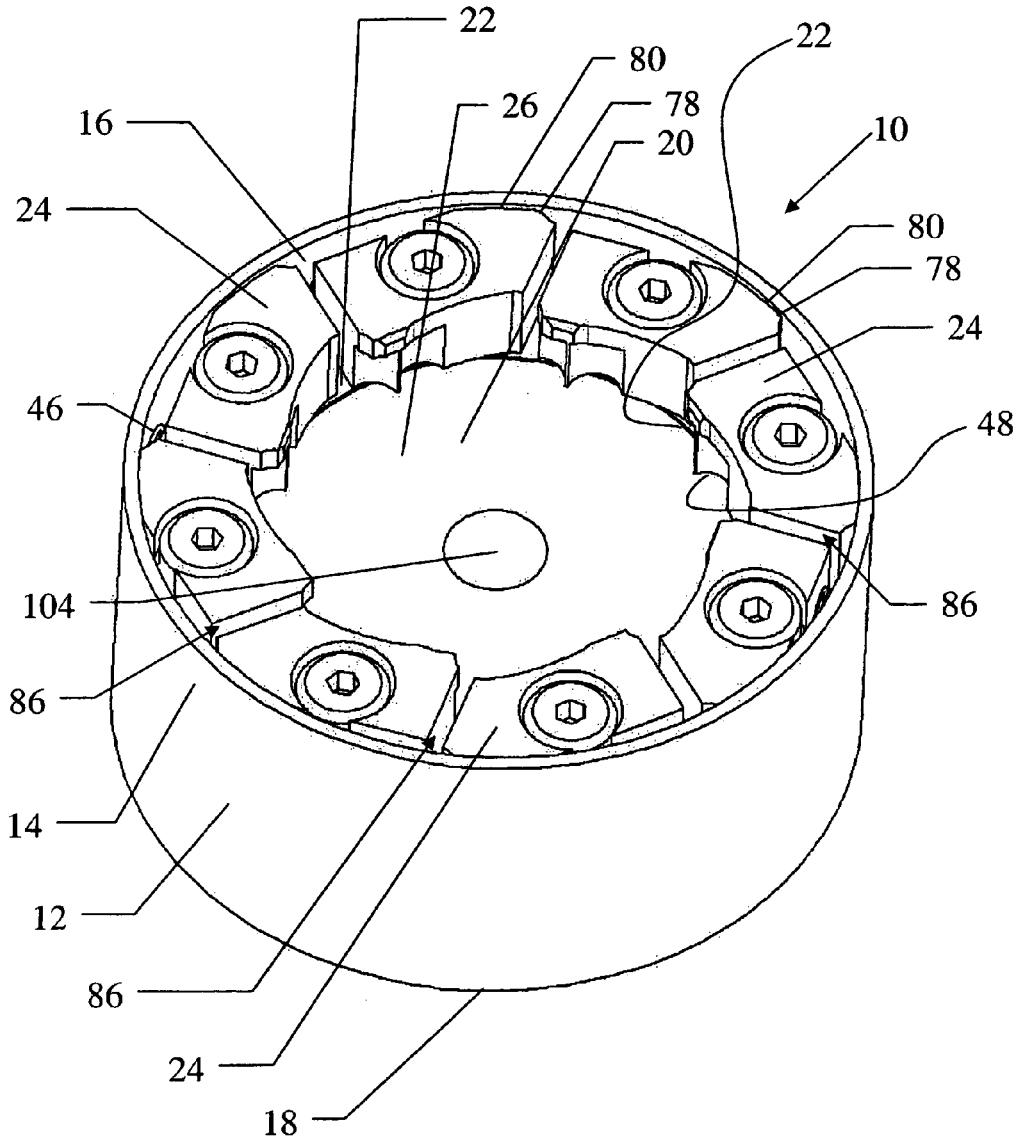
FIG. 1 is a bottom perspective view of an over-center self-adjusting equalizing cap chuck constructed in accordance with the teachings of the present invention.

Referring now to FIG. 1, there is shown an over-center, self-adjusting, equalizing cap chuck 10 constructed in accordance with the teachings of the present invention. The chuck 10 includes a housing 12 that is generally cylindrical in shape. The housing 12 is preferably made of a light-weight metal material, such as aluminum. The housing 12 has an outer annular peripheral surface 14 that defines an inner annular periphery 16 and includes an external face 18 and an internal face 20. The internal face 20 includes an annular area 22 bordering the inner annular periphery 16. As best observed in relation to FIG. 9 discussed hereinafter, the external face 18 is adapted for operative attachment to a spindle assembly of a capping machine. A plurality of engagement jaws 24 are aligned along the annular area 22 to form a border to a work piece receiving area 26 centrally located at the internal face 20. The engagement jaws 24 are generally horizontally orientated relative the inner annular periphery 16.

Figure 5:
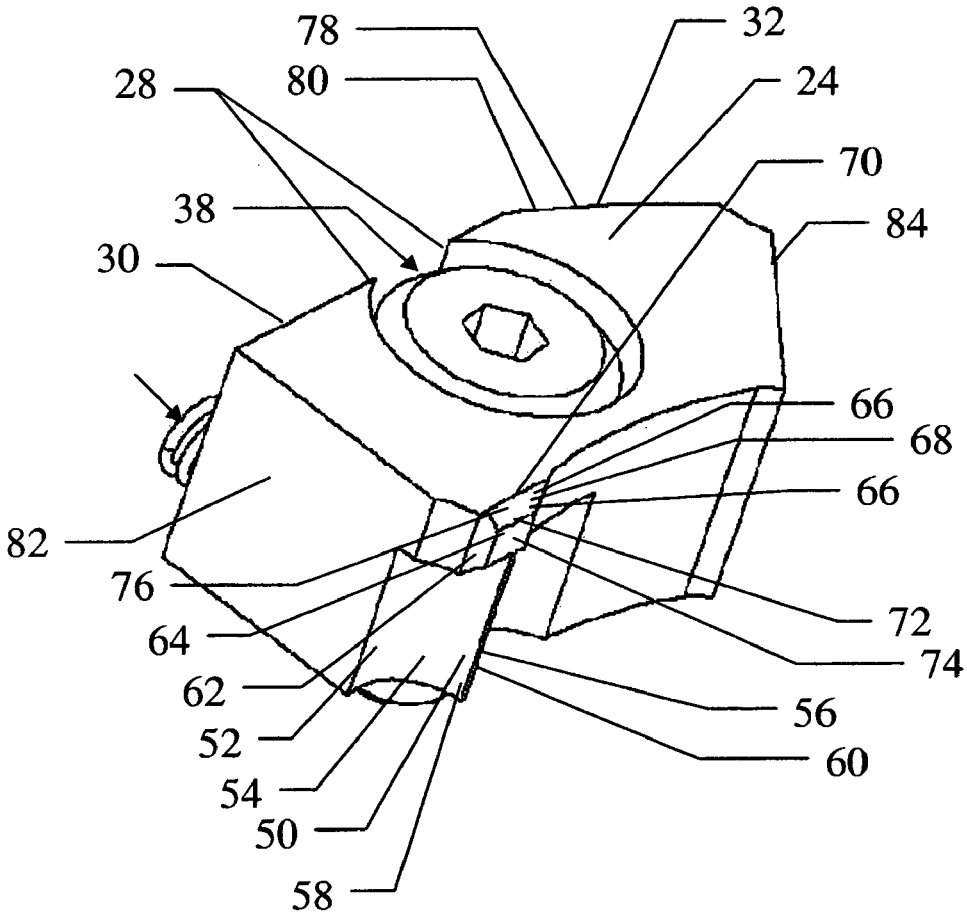
FIG. 5 a front perspective view of an individual engagement jaw constructed in accordance with the teachings of the present invention and shows a upper beveled area to a first side portion thereof.
Figure 6:
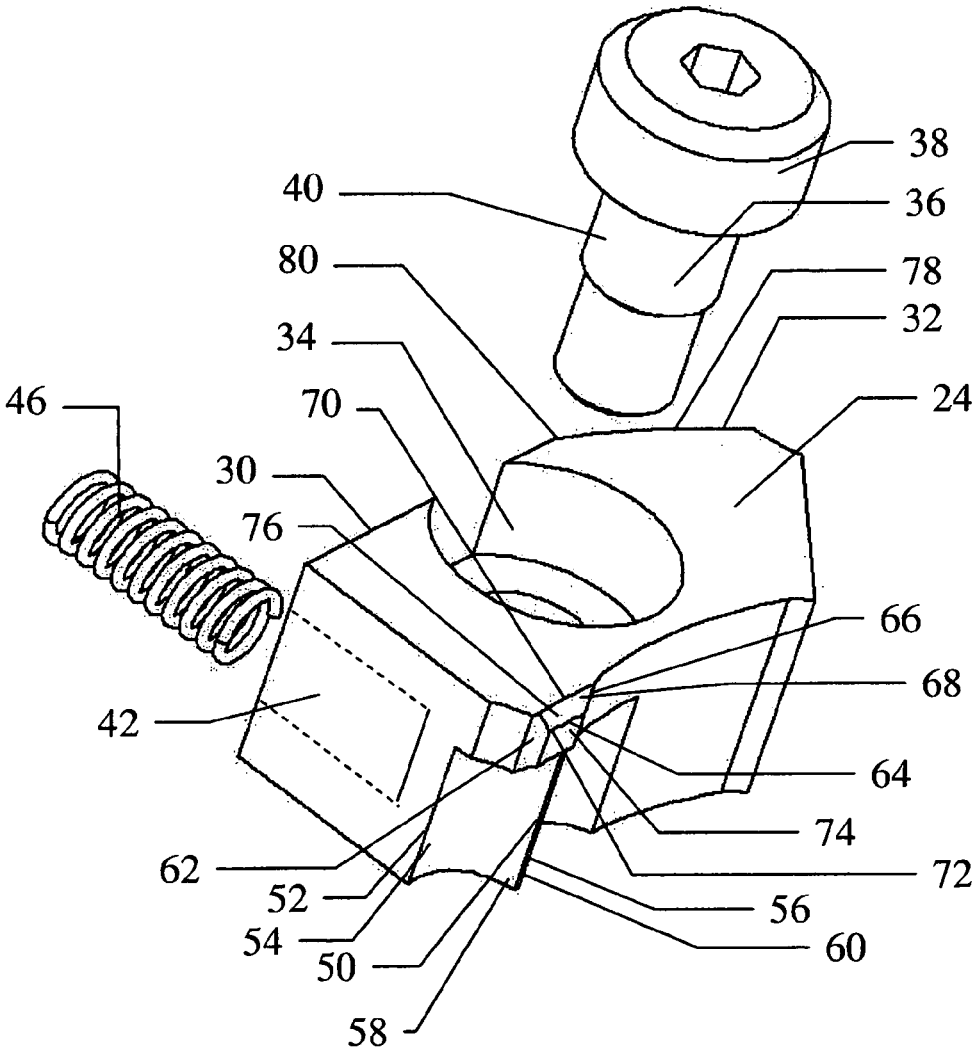
FIG. 6 is an exploded view of the individual engagement jaw of FIG. 5 and shows a central portion fastener displaced therefrom.

As best illustrated at FIGS. 5 and 6, engagement jaws 24 each have a central portion 28, a first side portion 30, and a second side portion 32.

The central portion 28 has a cavity 34 there through that accommodates a fastener 36, such as a dowel pin or a shoulder screw 38, therein to connect the engagement jaw to the housing 12. The connection establishes a pivot point 40 of the engagement jaw 24 relative to the housing 12 of the chuck 10.

The first side portion 30 includes an aperture 42 at a rear surface 44 thereof proximal of the inner annular periphery 16 of housing 12 that accommodates a bias spring 46 inserted therein to pre-dispose the engagement jaw 24 to a first open axial position 48 (see FIG. 1). The first side portion 30 also includes an extension finger 50 at a lower portion 52 of a lower frontal surface 54 thereof distal of the inner annular periphery 16 of housing 12 that serves as a work piece contact point 56 to apply a gripping pressure upon the outer periphery of a work piece. Although the extension finger 50 may be dimension and fashioned of varying embodiments so long as the same provides a work piece contact point 56, the extension finger 50 preferably is constructed with opposing interiorly directed sloped surfaces 58 and 60 terminating into work piece contact point 56 such that the engagement finger's vertical length is elongated and greater than its horizontal width. Above the engagement finger 50, the first side portion 30 also includes an upper portion 62 of an upper frontal surface 64 thereof distal of the inner annular periphery 16 that has as an interior facing work piece lead in member 66. The lead in member 66 has a upper beveled area 68 that is preferably sloped approximately 30 degrees downward of top surface 70 to a bevel termination edge 72 that serves as an upper border to an interior facing flush surface 74 that extends at least partially traverse of and above the engagement finger 50. In function, upper beveled area 68 of the front facing work piece lead in member 66 serves as an actuator 76 countering the bias spring 46 when first contacted by a work piece. As the chuck 10 seats upon a work piece, such as a threaded bottle cap, an outer top portion of the bottle cap will contact the upper beveled area 68 and slide downwardly thereof to interior facing flush surface 74.

The second side portion 30 of engagement jaw 22 includes a stop surface 78 at the rear surface 80 thereof proximal of the inner annular periphery 16. In use, the stop surface 78 is initially disposed by the bias spring 46 to abut against the inner annular periphery 16 of housing 12 but upon the upper beveled area 68 being actuated by a work piece, the stop surface 78 moves away from the inner annular periphery 16.

A first end surface 82 of first side portion 30 and a second end surface 84 of second side portion 32 define each engagement jaw 24 as a separate integral unit independent of each other such that when a plurality of engagement jaws are aligned along the annular area 22 to form a border to a work piece receiving area 26 centrally located at the internal face 20 there is a gap space 86 between adjacent engagement jaws preventing contact among the same.

Figure 3:
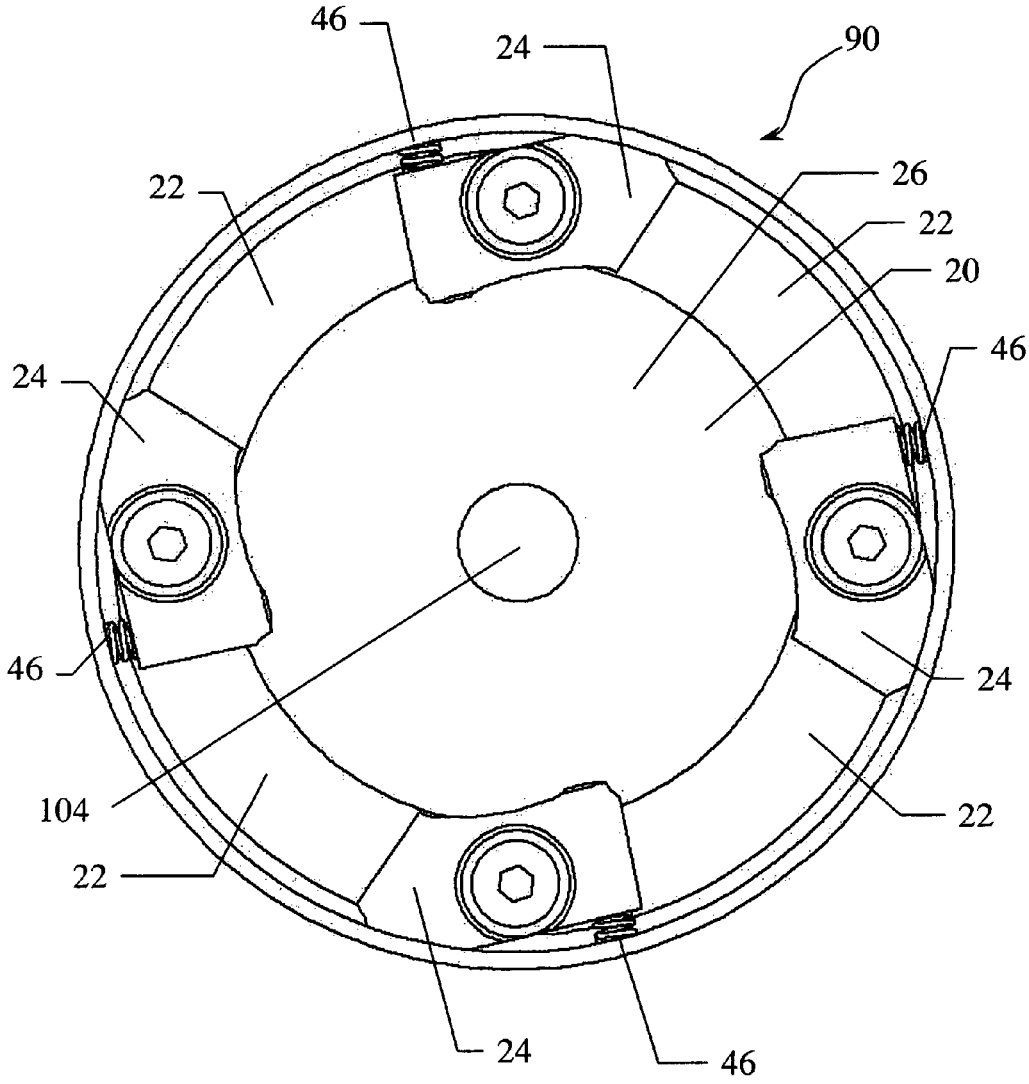
FIG. 3 is a bottom view of an alternative embodiment cap chuck similar to FIG. 1 but now showing only four engagement jaws distributed approximately 90 degrees from each other.
Figure 4:
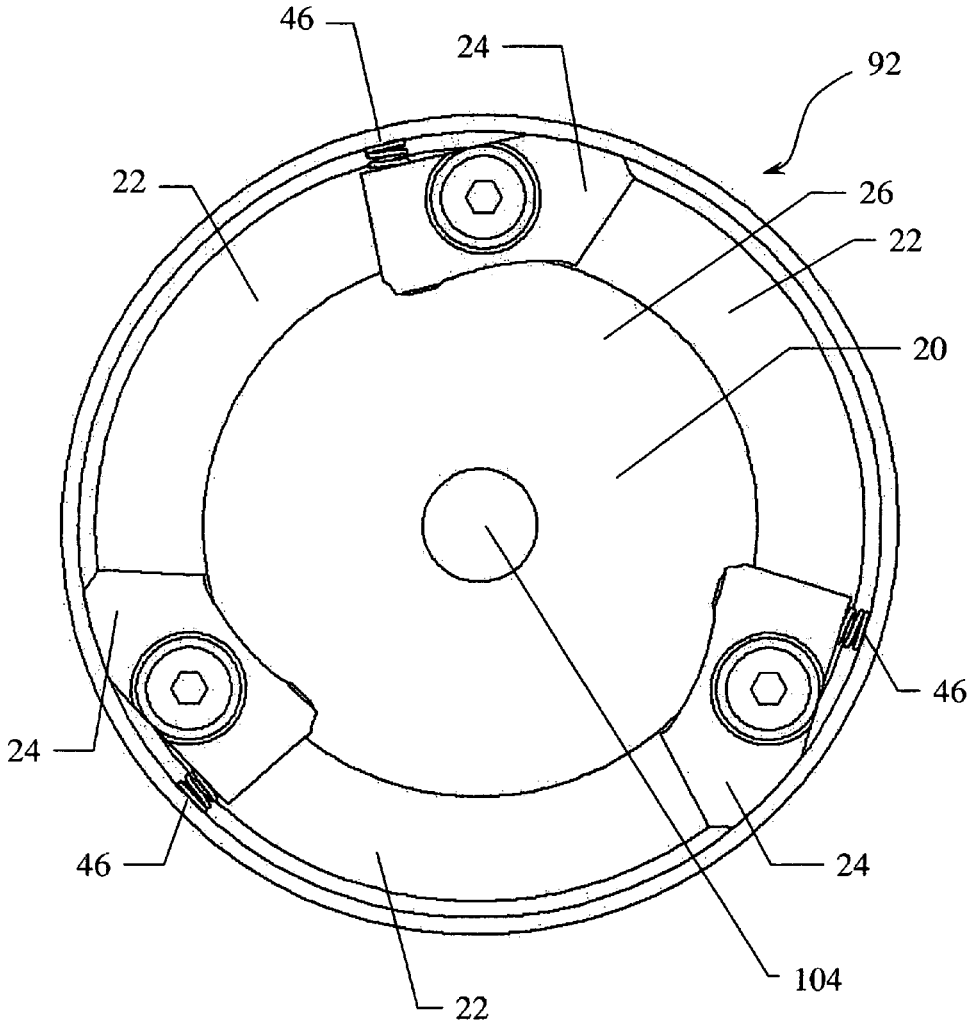
FIG. 4 is a bottom view of a further alternative embodiment cap chuck similar to FIG. 3 but now showing only three engagement jaws distributed approximately 120 degrees from each other.

The number of engagement jaws 24 aligned along annular area 22 may vary. In FIG. 1, chuck 10 has eight engagement jaws 24 equally aligned along the entire 360 degrees of the annular area 22 to form a border to a work piece receiving area 26 centrally located at the internal face 20. In FIG. 3, chuck 90 has four engagement jaws 24 equally spaced approximately 90 degrees apart along annular area 22 to form a border to the work piece receiving area 26. In FIG. 4, chuck 92 has three engagement jaws 24 equally spaced apart approximately 120 degrees apart along annular area 22 to form a border to a work piece receiving area 26. In all of the foregoing embodiments, as best observed at FIG. 9, a durable wear surface 94 may be placed upon annular area 22 to serve as a durable wear plate or metallic base for the plurality of engagement jaws. Durable wear surface 94 preferably is a harden piece of annular steel band.

Figure 7:
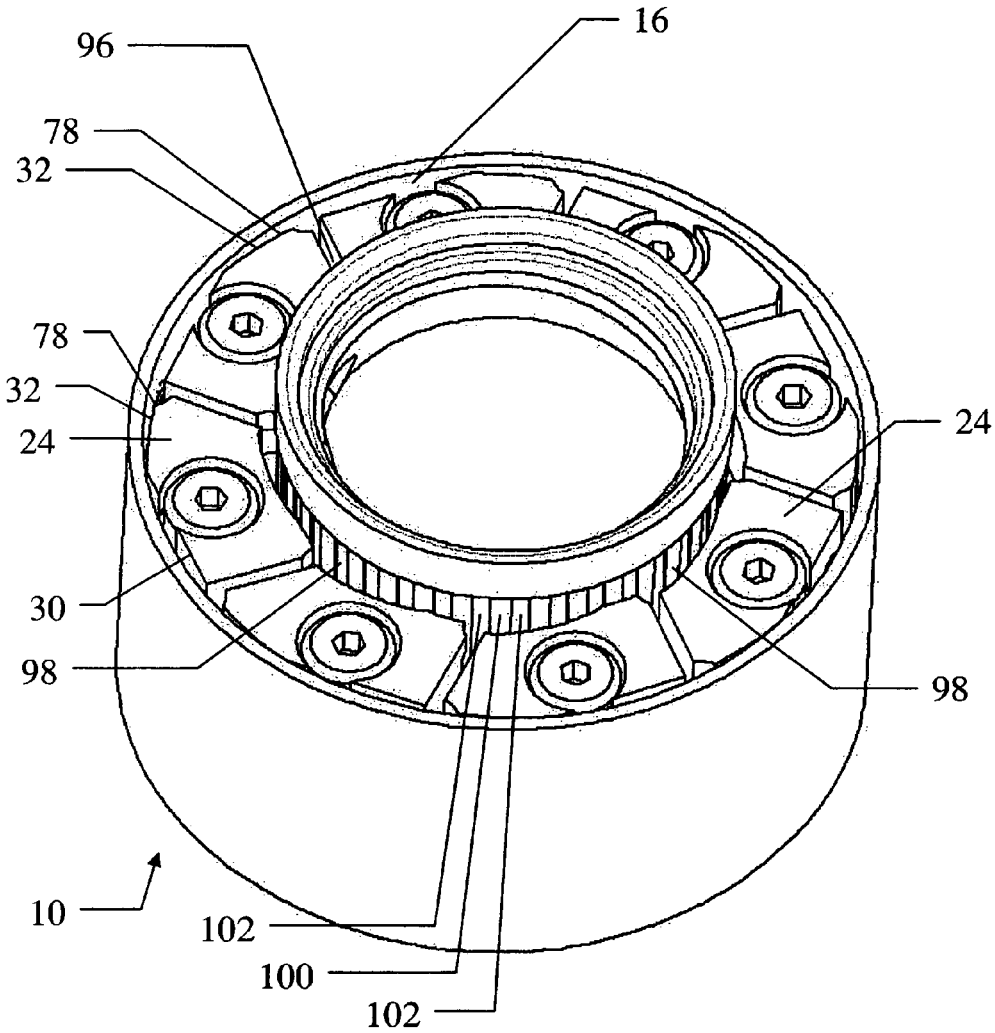
FIG. 7 is a bottom view of the cap chuck of FIG. 2 partially engaging a threaded bottle cap.
Figure 8:
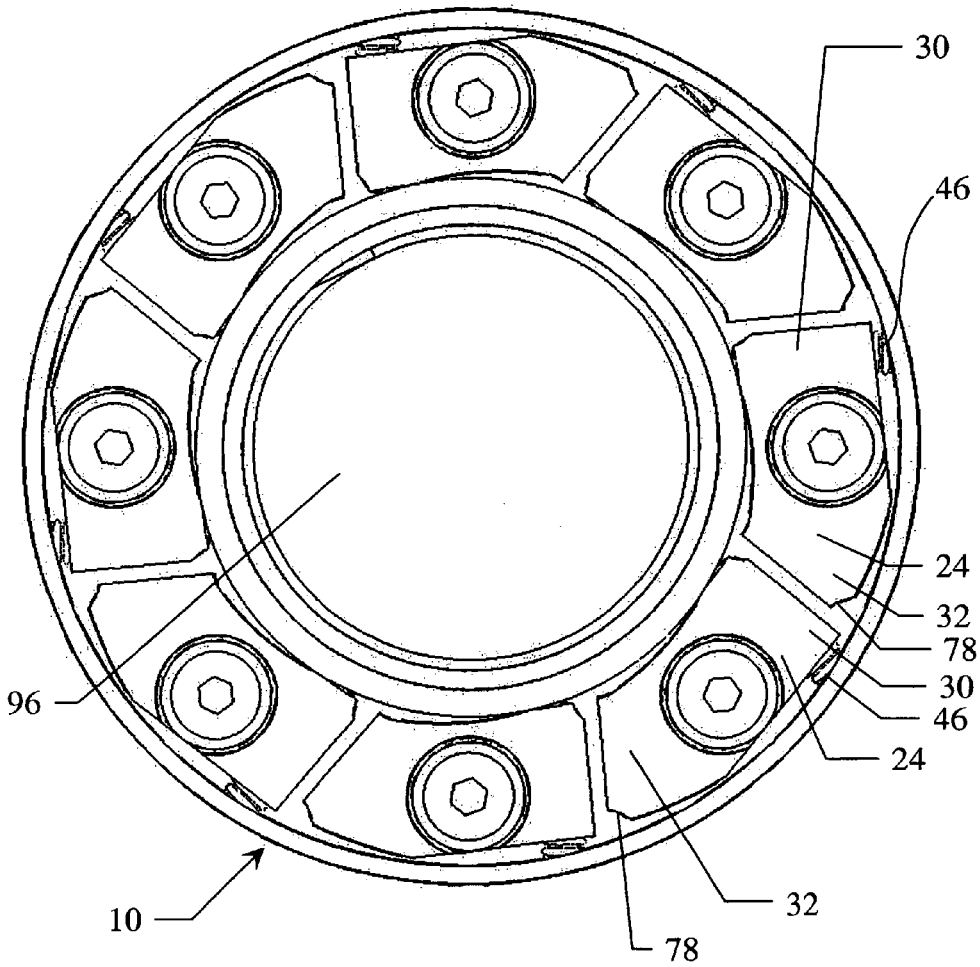
FIG. 8 is a bottom view of the cap chuck of FIG. 7 with the threaded bottle cap fully engaged therein.

FIGS. 7 and 8 illustrate the interaction of the preferred embodiment chuck 10 with a work piece, namely a threaded bottle cap 96.

In FIG. 7, chuck 10 has partially received threaded bottle cap 96 which has a serrated outer periphery 98 defining a series of grooves 100 between adjacent splines 102. When an outer top portion of the bottle cap 96 contacts upper beveled area 64 of the engagement jaw 24 and slides downwardly thereof to interior facing flush surface 74, the first side portion 30 moves in a direction proximal to the inner annular periphery 16 of housing 12 while displacing stop surface 78 of the second side portion 32 away from its former pre-disposed position in abutment to the inner annular periphery 16 of housing 12. During this movement, extension finger 50 engages a groove 100 of the serrated outer periphery 98 of bottle cap 96 so as to receive the bottle cap within work piece receiving central area 26, and, in use, to apply a gripping pressure in a direction toward a center-point 104 of the work piece receiving central area. In this fashion, the gripping pressure applied to a work piece is directed in an over-center manner, namely toward the center-point 104. As the engagement jaw 24 applies gripping pressure towards the center-point 104 of the work piece receiving central area 26, the intervening work piece opposes the same to achieve an efficient tightening of the engagement jaws 24 against the work piece with a minimal degree of grip force. This is particularly advantageous because the work piece may be received within the chuck with a desirable minimal or light initial grip force to avoid nicks or abrasion of the work piece's outer periphery, yet in torque use during spindle capping machine operations, the over-center grip upon the work piece achieves a strong hold during capping. Further, when the work piece is a serrated bottle cap 96, the extension finger 50 of each engagement jaw 24 is secured within a groove 100 of the bottle splines 102 at an angle of contact hold to avoid slippage over the splines.

In FIG. 8, bottle cap 96 is fully seated in chuck 10 and all engagement jaws exert a separate point of pressure upon the bottle cap in the same axial plane until the pressure thereon is equalized and a second closed axial position of the engagement jaws for receiving and gripping the cap is achieved. In this manner, the limited axial rotational movement of the engagement jaws between the first and second axial positions can accommodate eccentricities, deviations, and variations in work piece cap size or characteristics. For example, with a cylindrical work piece that is slightly out of round, one of the engagement jaws will engage the work piece first and subsequent independent engagement jaws can collectively adjust their securing hold within the range of their limited axial rotational movement. With the work piece serrated bottle cap 96 secured, the equalizing chuck 10 may be rotated to perform the desired machine operations on the work piece in a manner known in the spindle and capping machine arts.

Figure 2:
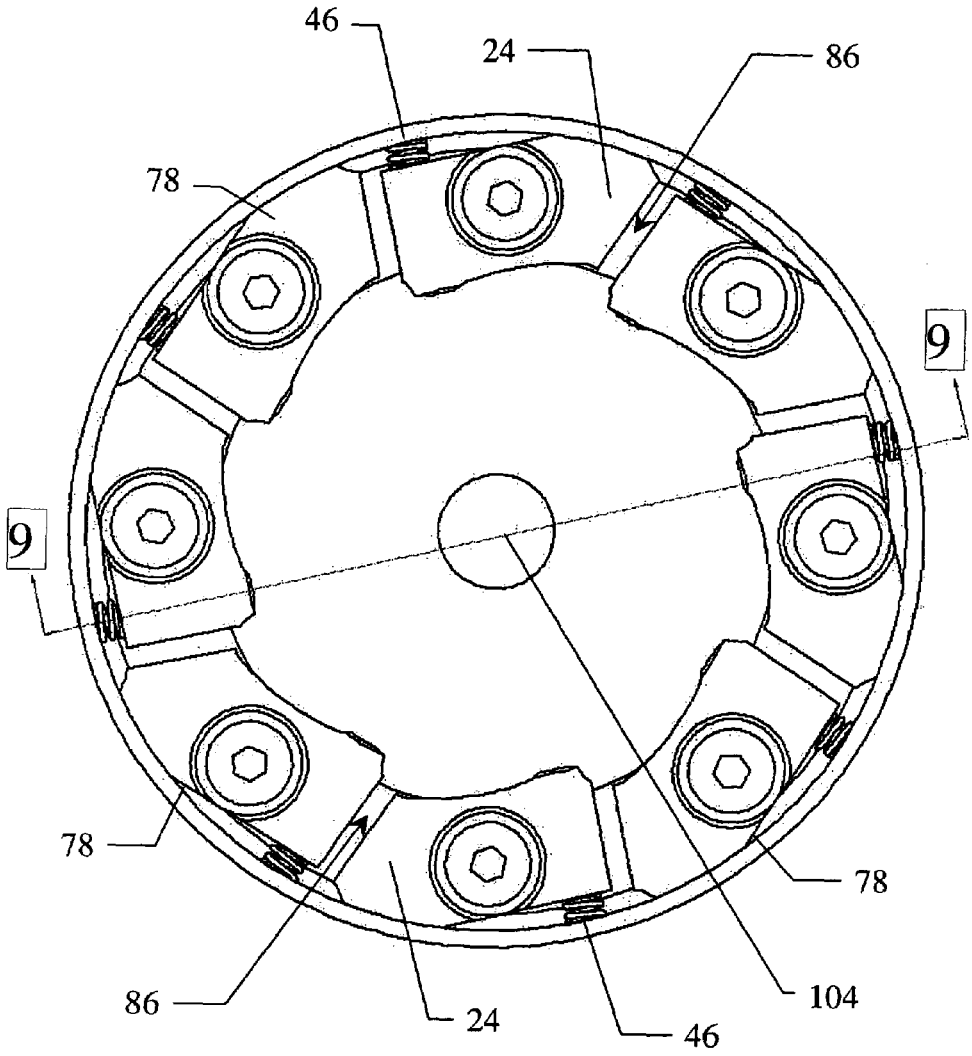
FIG. 2 is a bottom view of the cap chuck of FIG. 1.
Figure 9:
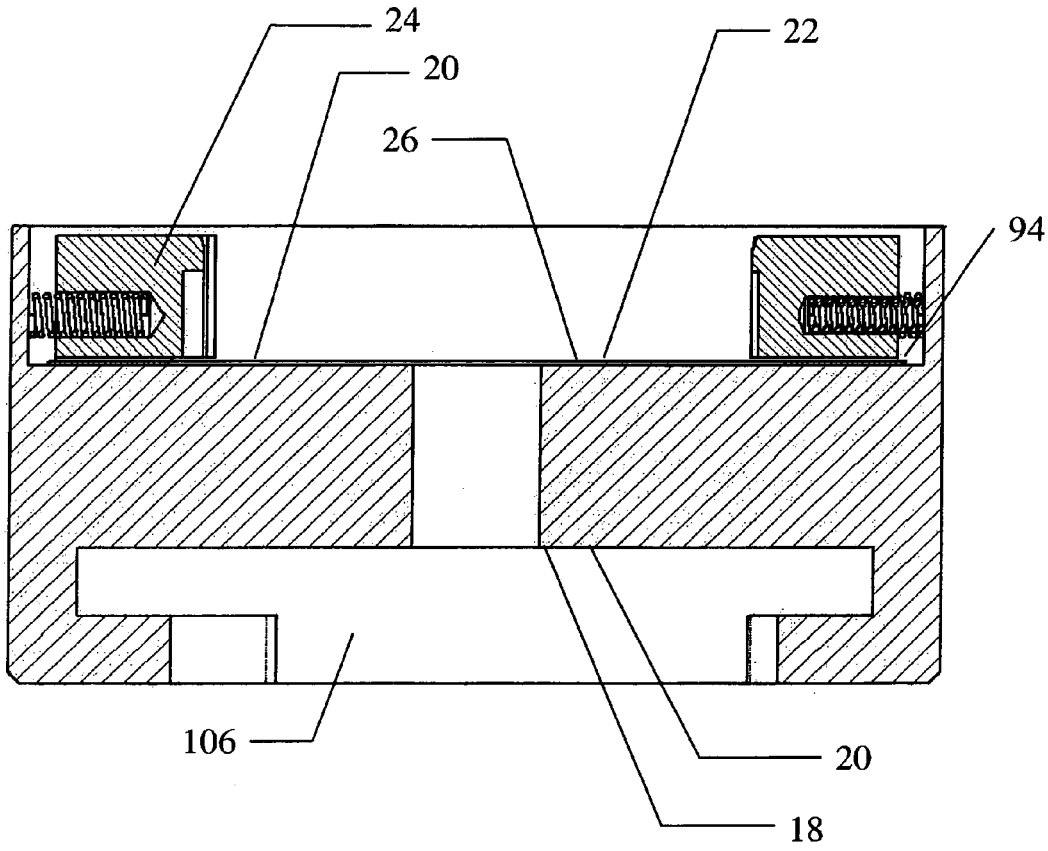
FIG. 9 is a cross-sectional view of the cap chuck of FIG. 1 taken along FIG. 2 line 9—9 and shows an external face of the cap chuck housing adapted for operative attachment to a spindle of a capping machine.

FIG. 9 is a cross-sectional view of the cap chuck 10 of FIG. 1 taken along the line 9—9 of FIG. 2 and shows an example of how the external face 18 of the cap chuck housing 12 may be adapted for operative attachment to a spindle of a capping machine. The exterior face 18 of cap chuck 10 has a quick-change slot 106 for bayonet cam locking or mated gear attachment to a capping machine spindle as known in the capping machine arts.

The cap chucks 10, 90, and 92 previously described dispose the extension finger 50 of each engagement jaw 24 at an angle of contact to a work piece held therein within a range of 22 to 38 degrees, preferably 30 degrees, from the center-point 104 of the work piece receiving central area 26. In certain capping operations however, it is desirable for cap chuck engagement jaws to grip a work piece with a more direct angle of contact. For example, certain serrated bottle caps may have finely patterned serrations having a narrow groove between more closely spaced splines. For such bottle caps, a more direct angle of engagement jaws to bottle cap contact is desirable to avoid slippage over the splines. In FIGS. 10 through 16 there is illustrate an alternative embodiment over-center self adjusting cap equalizing chuck which employs a pair of opposing bias springs operative with an engagement jaw there between to maintain a more direct angle of engagement jaw contact with a work piece.

Figure 10:
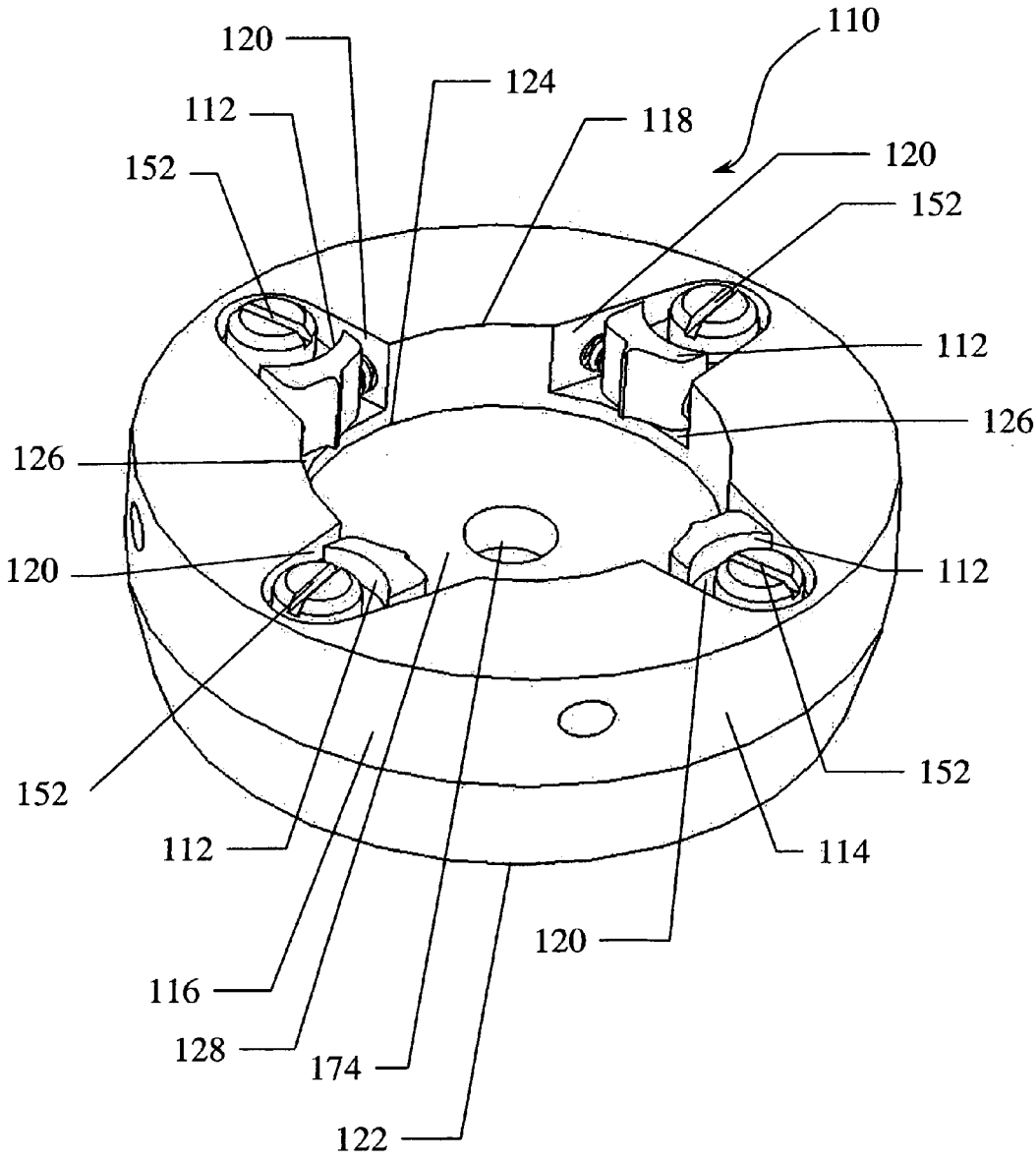
FIG. 10 is a bottom perspective view of an alternative embodiment over-center self adjusting cap equalizing chuck constructed in accordance with the teachings of the present invention which has four dual spring engagement jaws distributed approximately 90 degrees from each other.

In FIG. 10 over-center self-adjusting equalizing cap chuck 110 has a plurality of engagement jaws 112 distributed approximately 90 degrees from each other. Cap chuck 110 includes a housing 114 having an outer peripheral surface 116, an interior surface 118 having a plurality of pocket areas 120 corresponding to the number of the plurality of engagement jaws 112, an external face 122 adapted for operative attachment to a capping machine, and an internal face 124 having a work piece receiving central area 126 bordering the interior surface 118. The pocket areas 120 are set within interior surface 118 and distributed along an annular area 126 thereof bordering the work piece receiving central area 128. The annular area may optionally include a wear surface 130 such as a metallic steel band or wear plate (see FIG. 14) that serves as a floor for the pocket area 120. As best observed in the bottom view of FIG. 11, each of the pocket areas 120 are defined, in part, by opposing walls 132 and 134, each, respectively, having bores 136 and 138 therein axially aligned to one another that accommodates bias springs 140 and 142 therein. Each interior surface pocket area 120 includes an engagement jaw 112 disposed therein in a more of a vertical orientation as compared to prior embodiments of the present invention. As illustrated in the front perspective view of FIG. 12, each engagement jaw 112 has a front portion 144, a rear portion 146 and a side periphery 148. The rear portion 146 includes a cavity 150 there through which, can accommodate a fastener 152 therein (see FIG. 10) to connect the engagement jaw 112 within the pocket area 120 and to establish a pivot point of the engagement jaw supporting a limited axial rotational movement thereof between a first axial position and a second axial position within the pocket area. The front portion 144 of engagement jaw 112 has an extension finger 154 at a frontal surface 156 thereof that serves as a work piece contact point 158 to apply a gripping pressure upon the outer periphery of a work piece. Although the form of the extension finger may vary so long as the same provides a work piece contact point 158, the extension finger 154 preferably is constructed with opposing interiorly directed sloped surfaces 160 and 162 that terminate into work piece contact point 158 such that the engagement fingers vertical length is elongated and greater than its horizontal width. The engagement finger 154 includes an upper beveled area 164 which is preferably sloped approximately 30 degrees downward of the top surface 166 of the front portion 144 to a bevel termination edge 168 that extends at least partially traverse of and above the work piece contact point 158. In function, upper beveled area 164 serves as an actuator 170 countering the bias springs 140 and 142 when first contacted by a work piece. Similar to previously described cap chuck embodiments, as the cap chuck 110 seats upon a work piece, such as a threaded bottle cap, an outer top portion of the bottle cap will contact the upper beveled area 164 and slide downwardly thereof to the work piece contact point 158 of the extension finger 154.

Figure 11:
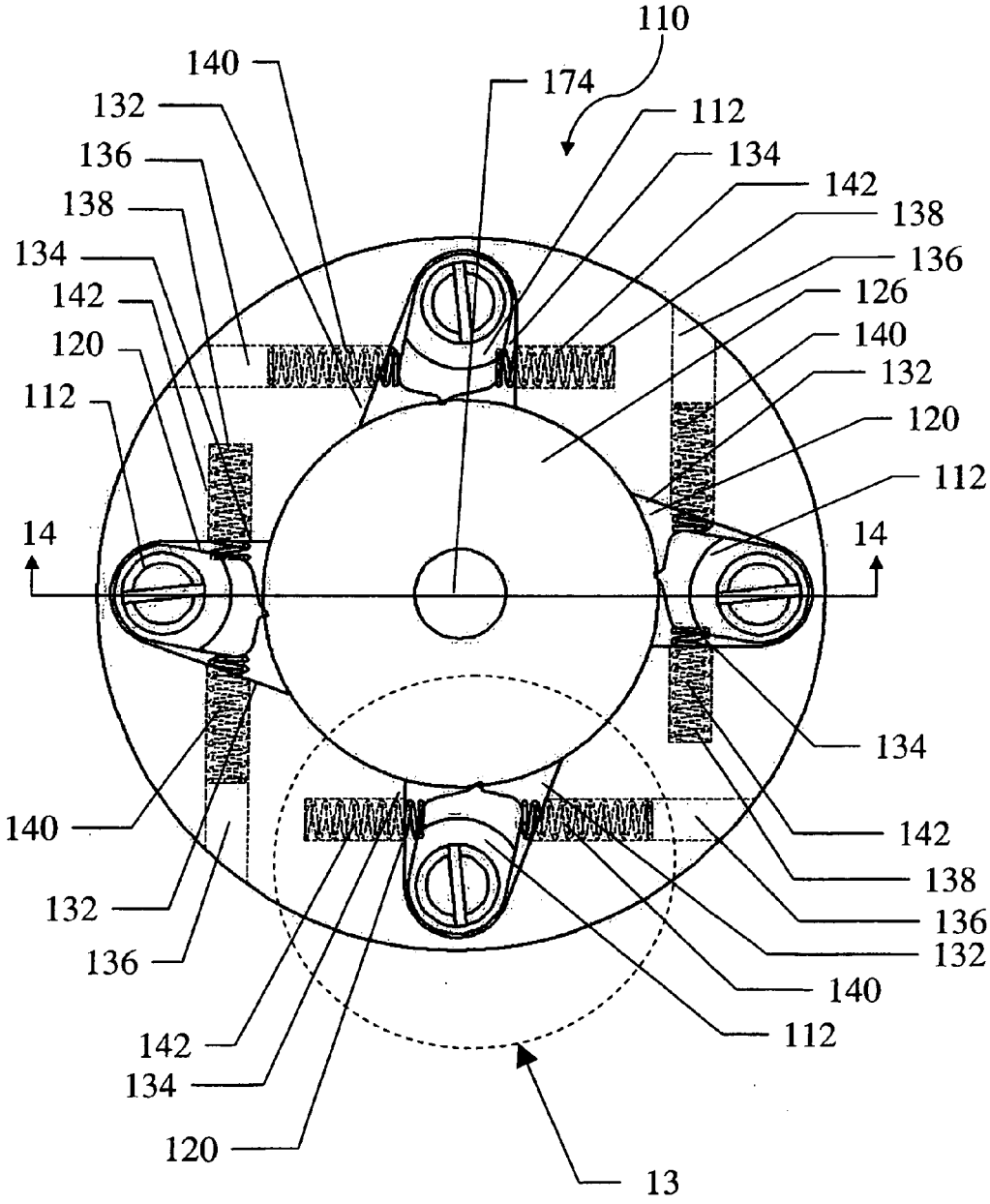
FIG. 11 is a bottom view of the alternative embodiment cap chuck of FIG. 10 with bias springs within bores exposed in hidden lines.
Figure 12:
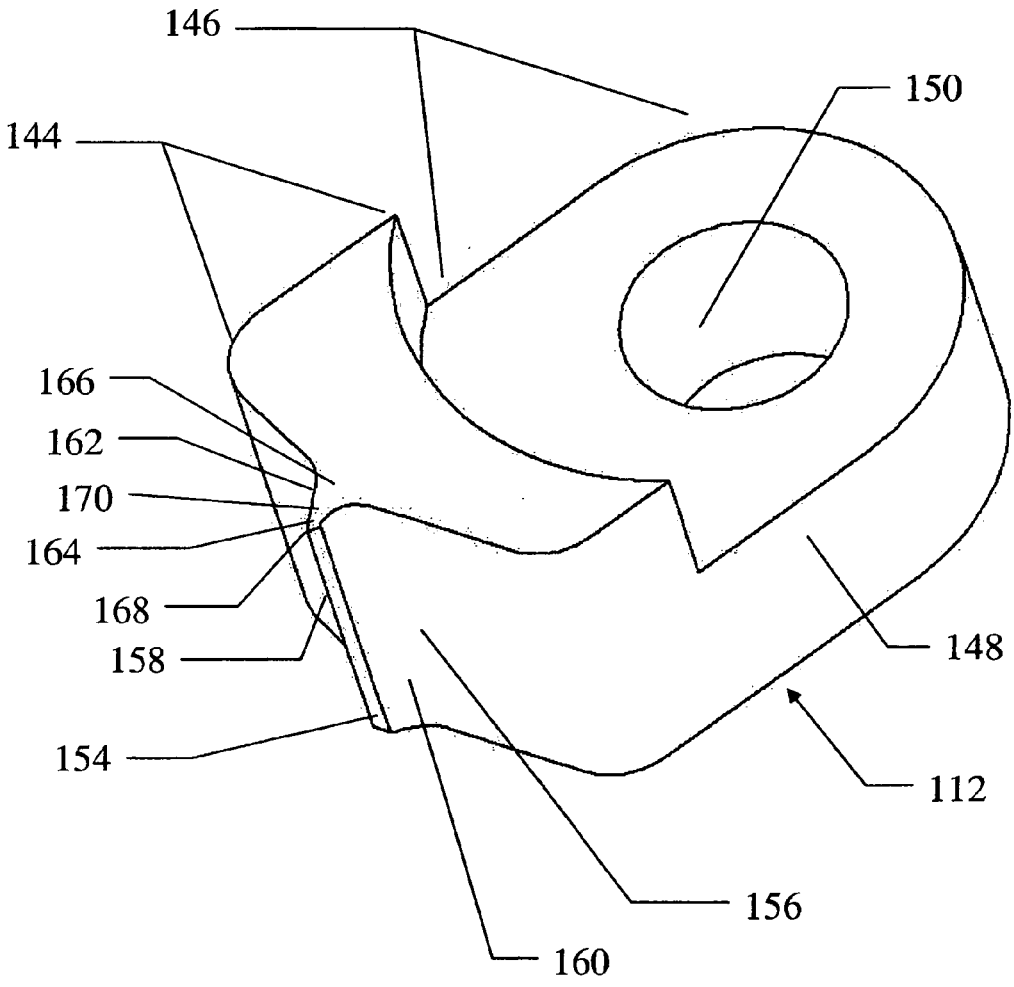
FIG. 12 a front perspective view of an individual engagement jaw of FIG. 10 and shows a front and rear portion thereof.
Figure 13:
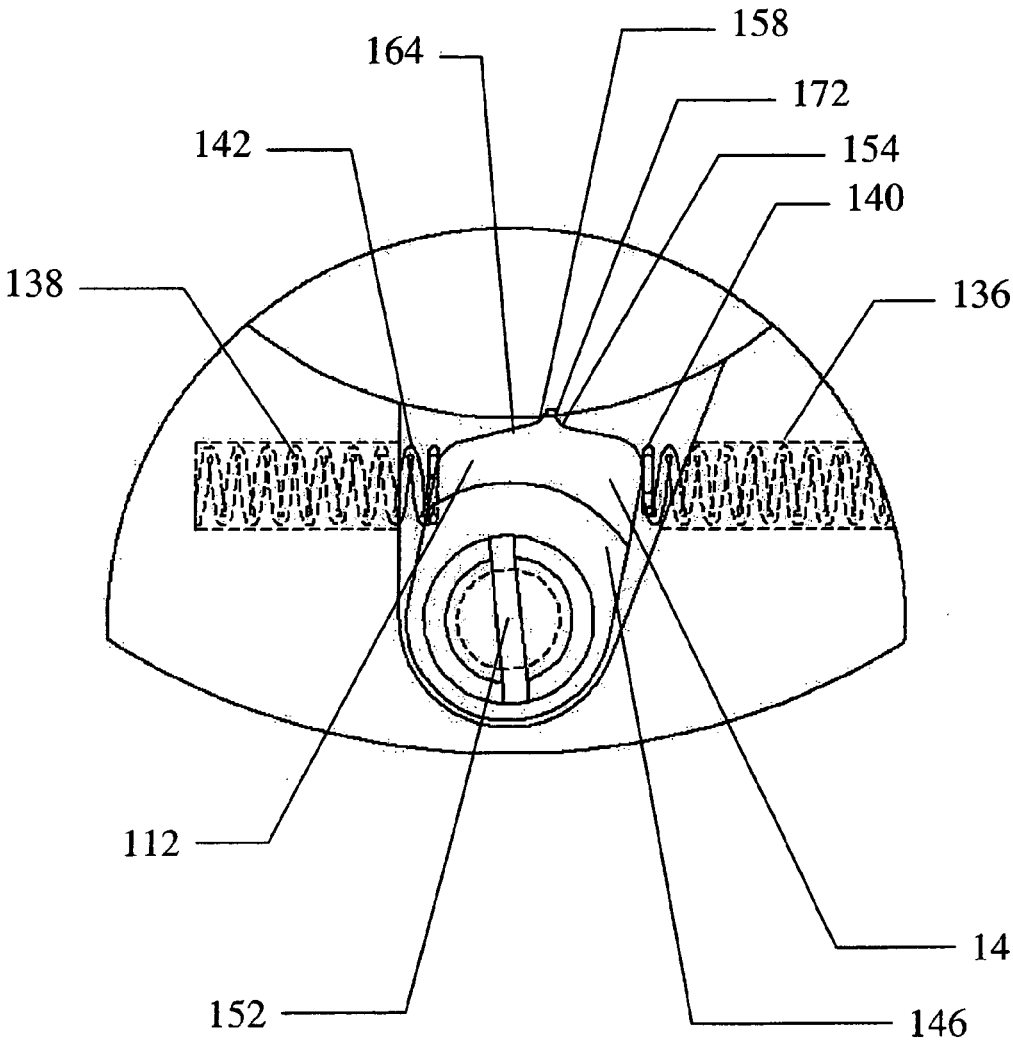
FIG. 13 is a bottom view of an individual engagement jaw of FIG. 10 set within a pocket area and shows a predisposition of the engagement jaw to a first axial position by a pair of opposed pocket area bias springs.

FIG. 13 is a detail view of area 13 of FIG. 11 and shows engagement jaw at a pre-disposed first axial position 172 open for reception of a work piece that is achieved by the equilibrium of bias springs 140 and 142. Preferably, bias springs are of an unequal tension such that one of the bias springs exerts a greater pressure upon engagement jaw 112 to establish the open work piece receiving first axial position 172 of the engagement jaw. In this regard, bias spring 140 is illustrated weaker than the stronger bias spring 142. Optionally, the interior base of either bias spring bore 136 or 138 may include a set screw to adjust the tension of the bias spring accommodated therein. Depending on the tension of the bias springs, the open work piece receiving first axial position 172 disposes the work piece contact point 158 of the extension finger 154 at an angle approximately 10 to 12 degrees to a center point 174 (see FIG. 10) of the work piece receiving central area 126 such that the same may accept a work piece. Upon actuation of the upper beveled area 164 above extension finger 154 by the seating of cap chuck 110 upon a work piece, such as serrated bottle cap 176 of FIGS. 15 and 16, each engagement jaw 112 moves inward in limited axial rotation to a second axial position engaging the work piece which is approximately 8 to 10 degrees of the center-point 174 of work piece receiving central area 126. As observed in FIGS. 15 and 16, cap chuck 110, in torque use, secures the work piece serrated bottle cap 176 in an over-center manner as previously discussed relative the foregoing embodiments of the present invention. In this regard, a gripping pressure is directed towards a center-point 174 of the work piece receiving central area 126 wherein the intervening work piece opposes the same to achieve an efficient hold of engagement jaws 112 against the work piece with a minimal degree of grip force. The more direct angle of contact of each engagement jaw 112 within a groove 178 between adjacent splines 180 of the serrated bottle cap avoids slippage over the splines. Similar to prior embodiments of the present invention, when serrated bottle cap 176 is seated in cap chuck 110, the independent engagement jaws 112 exert separate points of pressure upon the bottle cap in the same axial plane until the pressure thereon is equalized and a second closed axial position of the engagement jaws for gripping the cap is achieved. Again, this limited axial rotational movement of the engagement jaws between the first and second axial positions can accommodate eccentricities, deviations, and variations in work piece cap size or characteristics.

Figure 14:
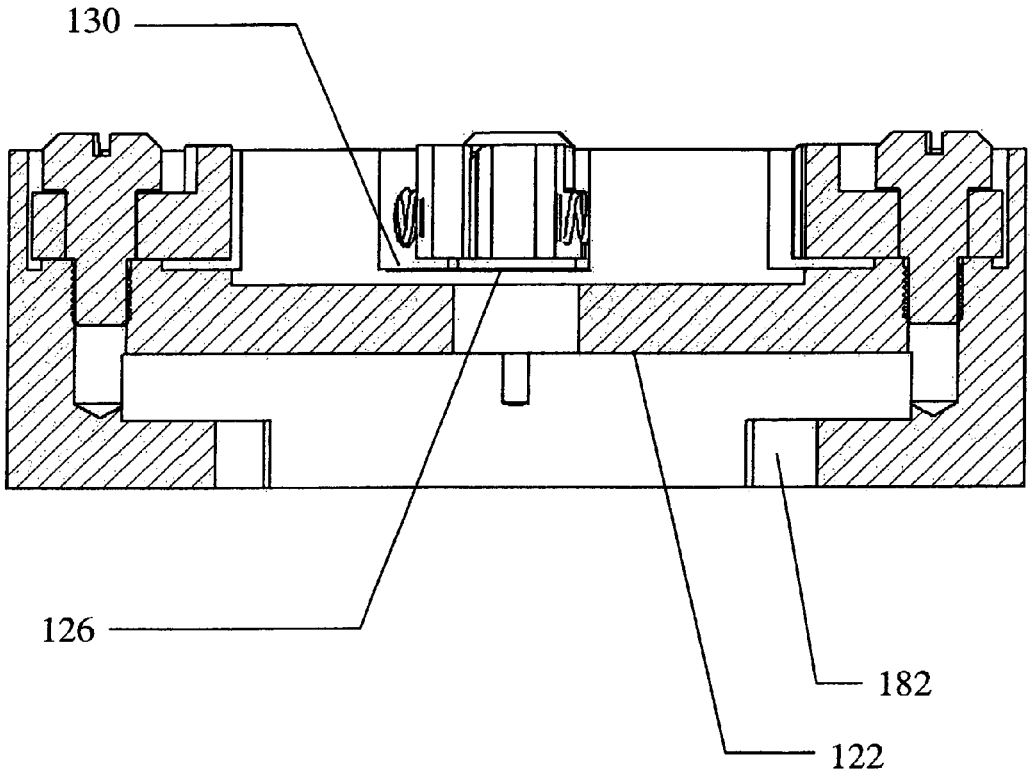
FIG. 14 is a cross-sectional view of the alternative cap chuck of FIG. 10 taken along FIG. 11 line 14—14 and shows an external face of the alternative cap chuck housing adapted for operative attachment to a spindle of a capping machine.
Figure 15:
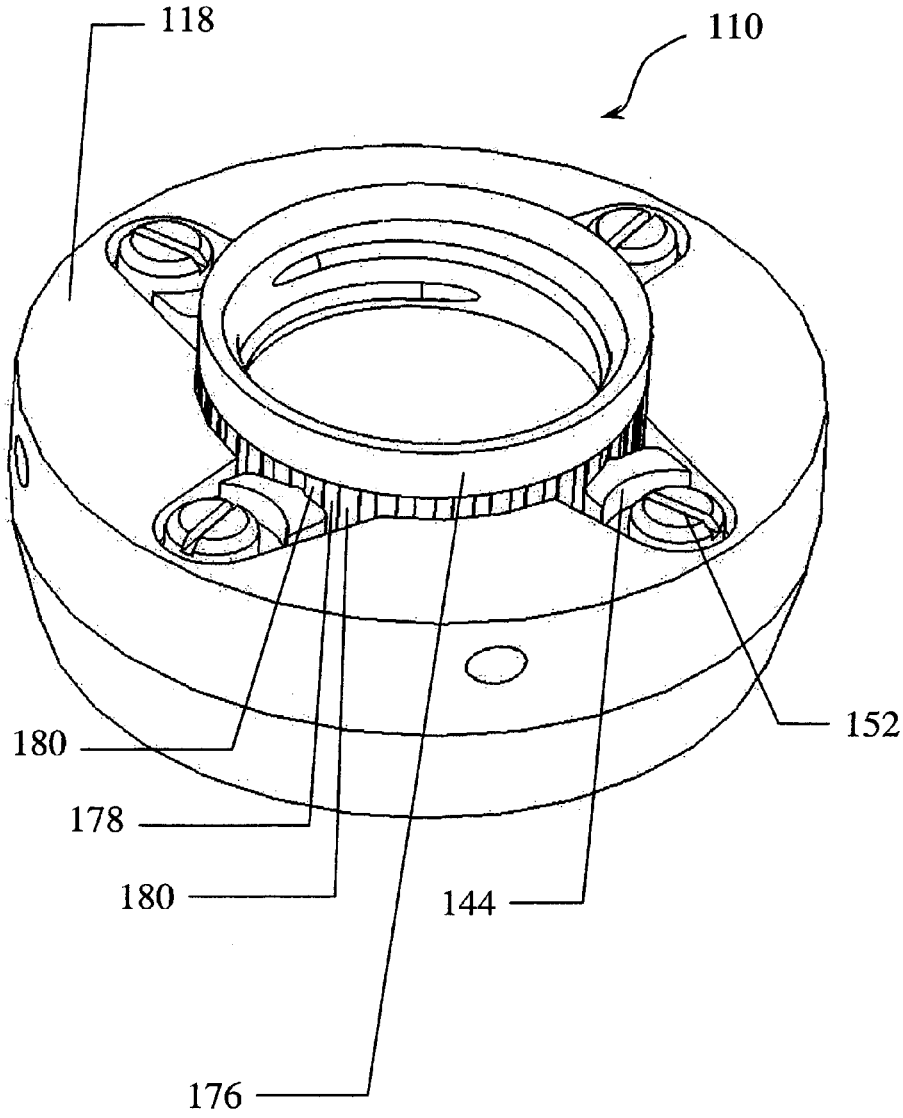
FIG. 15 is a perspective view of the alternative cap chuck of FIG. 10 with a threaded bottle cap fully engaged therein.
Figure 16:
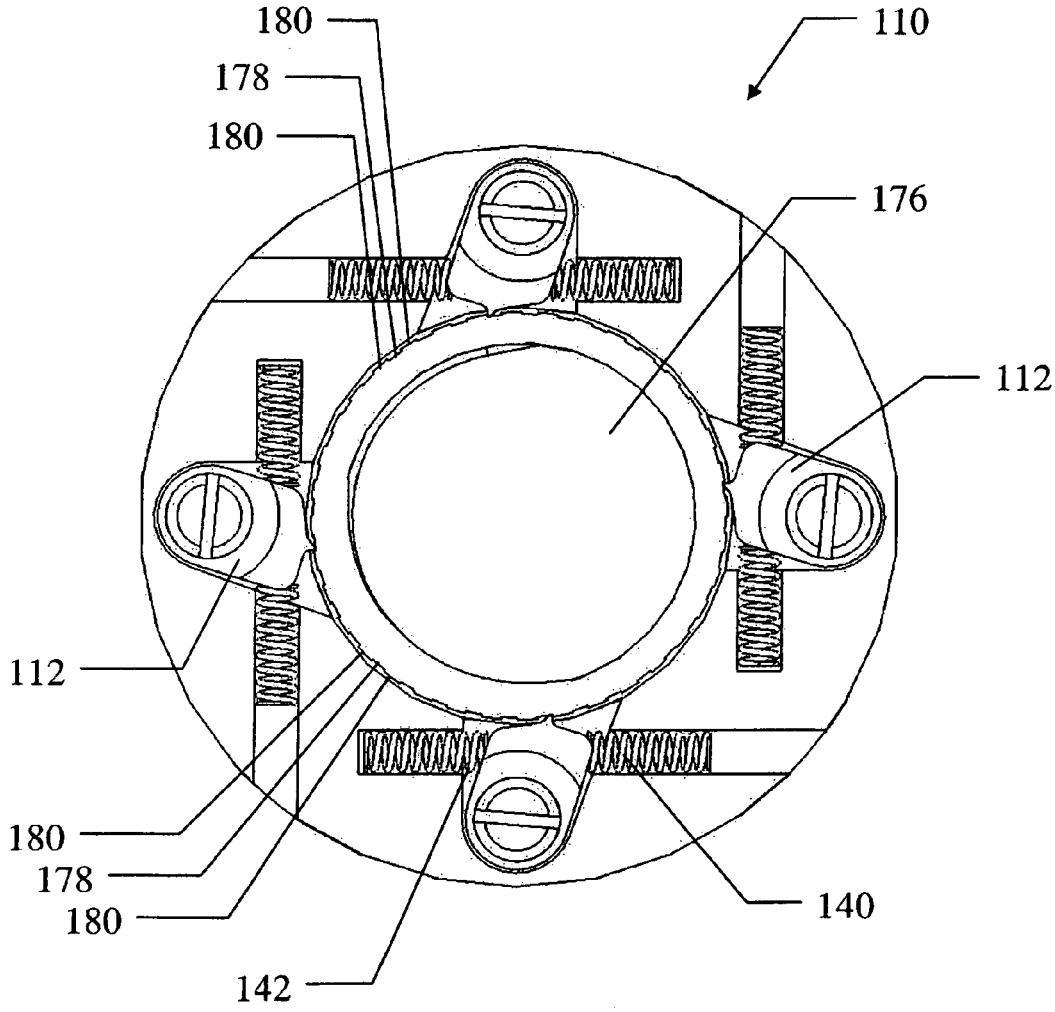
FIG. 16 is a bottom view of the alternative cap chuck of FIG. 10, with bias springs within bores exposed, engaging a bottle cap having a serrated outer periphery.

FIG 14 is a cross-sectional view of the cap chuck 110 taken along the line 14—14 of FIG. 11. Similar to prior embodiments of the present invention, the exterior face 118 of cap chuck 110 has a quick-change slot 182 for bayonet cam locking or mated gear attachment to a capping machine spindle as known in the capping machine arts.

As in prior embodiments of the present invention be number of engagement jaws 112 of cap chuck 110 may vary and each of the engagement jaws are independent of and segregated from one another as they are located in independent and segregated pocket areas 120 of interior surface 118.

From the foregoing description, it will be apparent that the over-center self-adjusting equalizing cap chuck of the present invention has a number of advantages, some of which have been described above and others of which are inherent in the invention. Also it will be understood that modifications can be made to the present invention described above without departing from its teachings. Accordingly, the scope of the invention is only to be limited as necessitated by the accompanying claims.

We claim:

1. A cap chuck comprising:

a housing having an outer peripheral surface and an inner annular periphery, an external face adapted for operative attachment to a capping machine, and an internal face having a work piece receiving central area and an annular area bordering said inner annular periphery;

a plurality of engagement jaws disposed along said annular area, each engagement jaw having a central portion, a first side portion, and a second side portion, said central portion having a cavity that accommodates a fastener therein to connect said engagement jaw to said housing and to establish a pivot point of said engagement jaw supporting limited axial rotational movement of said engagement jaw between a first axial position and a second axial position, said first side portion having a bias spring at a surface proximal of said inner annular periphery of said housing that pre-disposes said engagement jaw to said first axial position, an upper beveled area at least partially traversing an extension finger at a surface distal of said inner annular periphery of said housing, which, in use, serves as an actuator countering said bias spring when first contacted by a work piece;

said second side portion having a surface proximal of said inner annular periphery which, in use, is initially disposed by said bias spring to abut said inner annular periphery but upon said upper beveled area being actuated by said work piece moves away from said inner annular periphery, said extension finger, in torque use, being capable of contacting an outer periphery of said work piece to apply gripping pressure in a direction toward a center-point of said work piece receiving central area of said internal face, and each of said engagement jaws being independent of each other and exerting separate points of pressure upon a work piece until said pressure thereon is equalized.

2. The cap chuck of claim 1 wherein said upper beveled area of said surface distal of said inner annular periphery of said housing at least partially extends above said extension finger.

3. The cap chuck of claim 1 wherein said surface proximal of said inner annular periphery of said second side portion serves as a stop against said housing.

4. The cap chuck of claim 1 wherein said limited axial movement of said engagement jaw defines self-adjusting structure to accommodate variations of said work piece.

5. The cap chuck of claim 1 wherein said plurality of engagement jaws comprise three engagement jaws spaced approximately 120 degrees apart along said annular area.

6. The cap chuck of claim 1 wherein said plurality of engagement jaws comprise four engagement jaws spaced approximately 90 degrees apart along said annular area.

7. The cap chuck of claim 1 wherein said plurality of engagement jaws are equally spaced along 360 degrees of said annular area.

8. The cap chuck of claim 1 wherein said extension finger of each engagement jaw grips a work piece within the same axial plane.

9. The cap chuck of claim 1 wherein said extension finger of each engagement jaw is dimension to engage a groove of a work piece having a serrated outer surface.

10. The cap chuck of claim 1 wherein said extension finger of each engagement jaw is dimension to form an elongated vertical contact point with said work piece wherein its vertical length is greater than its horizontal width.

11. The cap chuck of claim 1 wherein said upper beveled area is sloped approximately 30 degrees.

12. The cap chuck of claim 1 wherein said extension finger is disposed in contact with said work piece within a range of 22 to 38 degrees from a center-point of said work piece receiving central area.

13. The cap chuck of claim 1 further including a wear surface upon said annular area.

14. The cap chuck of claim 13 wherein said wear surface is a metallic.

15. The cap chuck of claim 1 wherein said first side portion has an aperture at a surface proximal of said inner annular periphery of said housing that accommodates said bias spring therein.

16. A cap chuck comprising:

a housing having an outer peripheral surface, an interior surface having a plurality of pocket areas, an external face adapted for operative attachment to a capping machine, and an internal face having a work piece receiving central area bordering said interior surface;

a plurality of engagement jaws, each engagement jaw disposed within one of said pocket areas, said pocket areas defined, in part, by opposing walls each having a bore therein, each engagement jaw having a rear portion, a front portion, and a side periphery, said rear portion having a cavity that accommodates a fastener therein to connect said engagement jaw within said pocket area and to establish a pivot point of said engagement jaw supporting limited axial rotational movement of said engagement jaw between a first axial position and a second axial position within said pocket area, a pair of bias springs extending from said bores of said opposing walls and interactive with said engagement jaw there between that pre-disposes said engagement jaw to said first axial position, said front portion of said engagement jaw having an extension finger at a frontal surface thereof, said extension finger having an upper beveled area, which, in use, serves as an actuator when contacted by said work piece to counter said bias springs and accommodate said limited axial movement of said engagement jaw to said second axial position;

said extension finger, in torque use, being capable of contacting an outer periphery of said work piece to apply gripping pressure in a direction toward a center-point of said work piece receiving central area of said internal face, and each of said engagement jaws being independent of each other and exerting separate points of pressure upon said work piece until said pressure thereon is equalized.

17. The cap chuck of claim 16 wherein one of said pair of bias springs applies a greater pressure upon said engagement jaw than the other.

18. The cap chuck of claim 16 wherein said limited axial movement of said engagement jaw defines self-adjusting structure to accommodate variations of said work piece.

19. The cap chuck of claim 16 wherein said plurality of engagement jaws comprise four engagement jaws spaced approximately 90 degrees apart along said annular area.

20. The cap chuck of claim 16 wherein said extension finger of each engagement jaw grips a work piece within the same axial plane.

21. The cap chuck of claim 16 wherein said extension finger of each engagement jaw is dimension to engage a groove of a work piece having a serrated outer surface.

22. The cap chuck of claim 16 wherein said extension finger of each engagement jaw is dimension to form an elongated vertical contact point with said work piece wherein its vertical length is greater than its horizontal width.

23. The cap chuck of claim 16 wherein said upper beveled area is sloped approximately 30 degrees.

24. The cap chuck of claim 16 wherein said extension finger is disposed in contact with said work piece within a range of approximately 8 to 12 degrees from a center-point of said work piece receiving central area.

25. The cap chuck of claim 16 further including a wear surface serving as a floor to said pocket areas.

26. The cap chuck of claim 25 wherein said wear surface is metallic.

* * * * *